US011257321B2

(12) United States Patent
Penacho et al.

(10) Patent No.: US 11,257,321 B2
(45) Date of Patent: Feb. 22, 2022

(54) ENHANCED ELECTRONIC GAMING MACHINES AND METHODS FOR SAME PROVIDING MERGED GAME MATRICES WITH MERGED SYMBOL SET

(71) Applicant: Aristocrat Technologies Australia Pty Limited, North Ryde (AU)

(72) Inventors: Gary Joseph Penacho, Henderson, NV (US); Thomas Tuomey, Las Vegas, NV (US); Bradley Hendricks, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 24 days.

(21) Appl. No.: 16/933,905

(22) Filed: Jul. 20, 2020

(65) Prior Publication Data

US 2020/0349813 A1 Nov. 5, 2020

Related U.S. Application Data

(63) Continuation of application No. 15/976,637, filed on May 10, 2018, now Pat. No. 10,720,015, which is a continuation of application No. 29/616,125, filed on Sep. 1, 2017, now Pat. No. Des. 839,304.

(60) Provisional application No. 62/553,990, filed on Sep. 4, 2017.

(51) Int. Cl.
*G07F 17/32* (2006.01)
*G07F 17/34* (2006.01)

(52) U.S. Cl.
CPC ..... *G07F 17/3244* (2013.01); *G07F 17/3213* (2013.01); *G07F 17/3225* (2013.01); *G07F 17/34* (2013.01)

(58) Field of Classification Search
CPC ..... G07F 17/3244; G07F 17/3213; G07F 17/3225; G07F 17/34
USPC ..... 463/20
See application file for complete search history.

(56) References Cited

U.S. PATENT DOCUMENTS

| | | | |
|---|---|---|---|
| D299,142 | S | 12/1988 | Berg |
| D479,243 | S | 9/2003 | Ohashi |
| D562,338 | S | 2/2008 | Keohane |
| D579,456 | S | 10/2008 | Chen |
| D628,208 | S | 11/2010 | Potemski |
| D628,583 | S | 12/2010 | Kurozumi |
| D658,195 | S | 4/2012 | Cranfill |

(Continued)

FOREIGN PATENT DOCUMENTS

AU 2016228227 A1 4/2017

OTHER PUBLICATIONS

Australian Examination Report No. 1 for App. No. AU2019279996, dated Jan. 11, 2021, 4 pages.

(Continued)

*Primary Examiner* — Allen Chan
(74) *Attorney, Agent, or Firm* — McAndrews, Held & Malloy, Ltd.

(57) ABSTRACT

A method of merging a plurality of games into a single game on a gaming machine. A display displays first and second games. A game controller determines if a wager has been placed, and if the wager placed includes a base game wager and a game enhancement wager. Upon determining that the wager placed includes a base game wager and a game enhancement wager, the game controller merges the first and second games and a plurality of display positions into a merged game. The merged game selects symbols from the first game and the second game.

20 Claims, 14 Drawing Sheets

(56) References Cited

U.S. PATENT DOCUMENTS

| | | | |
|---|---|---|---|
| D664,550 | S | 7/2012 | Lee |
| D666,625 | S | 9/2012 | Gilmore |
| D668,261 | S | 10/2012 | Arnold |
| D668,671 | S | 10/2012 | Zaman |
| D669,091 | S | 10/2012 | Cranfill |
| D676,862 | S | 2/2013 | Ho Kushner |
| D679,722 | S | 4/2013 | Ray |
| D695,779 | S | 12/2013 | Edwards |
| D695,780 | S | 12/2013 | Edwards |
| D697,938 | S | 1/2014 | Lee |
| D702,701 | S | 4/2014 | Scharfeld |
| 8,832,598 | B2 | 9/2014 | Hirata |
| D719,969 | S | 12/2014 | Ebtekar |
| D728,585 | S | 5/2015 | Lee |
| D732,562 | S | 6/2015 | Yan |
| D750,659 | S | 3/2016 | Cranfill |
| D751,097 | S | 3/2016 | Sarafa |
| D757,786 | S | 5/2016 | Yan |
| D758,417 | S | 6/2016 | Chaudhri |
| D760,275 | S | 6/2016 | Zhang |
| D765,136 | S | 8/2016 | Lee |
| D771,111 | S | 11/2016 | Roberts |
| D772,240 | S | 11/2016 | Edstrom |
| D772,248 | S | 11/2016 | Quek |
| D772,273 | S | 11/2016 | Spector |
| D773,512 | S | 12/2016 | Miura |
| D778,310 | S | 2/2017 | Roberts |
| D785,007 | S | 4/2017 | Sugumaran |
| D785,664 | S | 5/2017 | Yao |
| D786,271 | S | 5/2017 | Randon |
| D790,563 | S | 6/2017 | Lam |
| D790,590 | S | 6/2017 | Hart |
| D791,168 | S | 7/2017 | Sun |
| D791,173 | S | 7/2017 | Hart |
| D792,451 | S | 7/2017 | Jeon |
| D794,661 | S | 8/2017 | Nishizawa |
| D794,664 | S | 8/2017 | Okabe |
| D800,745 | S | 10/2017 | Kyakuno |
| D801,354 | S | 10/2017 | Lee |
| D801,358 | S | 10/2017 | Jungmann |
| D801,995 | S | 11/2017 | Cho |
| D802,616 | S | 11/2017 | Hajimusa |
| D809,003 | S | 1/2018 | Sowden |
| D814,496 | S | 4/2018 | Bachman |
| D821,439 | S | 6/2018 | Sowden |
| D826,979 | S | 8/2018 | Rowny |
| D839,304 | S | 1/2019 | Penacho |
| D839,305 | S | 1/2019 | Hawkins |
| D841,048 | S | 2/2019 | Penacho |
| 2002/0047238 | A1 | 4/2002 | Ainsworth |
| 2006/0079313 | A1 | 4/2006 | Trainor |
| 2009/0227350 | A1 | 9/2009 | Inamura |
| 2011/0294567 | A1 | 12/2011 | Falciglia, Sr. |
| 2012/0040736 | A1 | 2/2012 | Penacho |
| 2014/0011567 | A1 | 1/2014 | Penacho |
| 2014/0094270 | A1 | 4/2014 | Cuddy |
| 2014/0162754 | A1 | 6/2014 | Tylman |
| 2014/0200066 | A1 | 7/2014 | Joshi |
| 2014/0295942 | A1 | 10/2014 | Kendall |
| 2015/0018070 | A1 | 1/2015 | Meyer |
| 2015/0212666 | A1 | 7/2015 | Daniel |
| 2015/0302703 | A1 | 10/2015 | Nelson |
| 2015/0356813 | A1 | 12/2015 | Mead |
| 2015/0379804 | A1 | 12/2015 | Casey |
| 2016/0093147 | A1 | 3/2016 | Penacho |
| 2016/0093150 | A1 | 3/2016 | Penacho |
| 2016/0189471 | A1 | 6/2016 | Penacho |
| 2017/0092047 | A1 | 3/2017 | Hendricks |
| 2018/0078847 | A1 | 3/2018 | Sorreta |
| 2018/0293846 | A1 | 10/2018 | Penacho |
| 2019/0073858 | A1 | 3/2019 | Penacho |
| 2019/0073859 | A1 | 3/2019 | Penacho |

OTHER PUBLICATIONS

Australian Examination Report No. 1 for App. No. AU2019279999, dated Feb. 8, 2021, 6 pages.

Office Action, dated Sep. 12, 2019, in U.S. Appl. No. 15/976,604, with a filing date of May 10, 2018.

Notice of Allowance dated Apr. 15, 2020 for U.S. Appl. No. 15/976,604 (pp. 1-7).

Notice of Allowance dated Apr. 15, 2020 for U.S. Appl. No. 15/976,637 (pp. 1-8).

ENHANCED ELECTRONIC GAMING MACHINES AND METHODS FOR SAME PROVIDING MERGED GAME MATRICES WITH MERGED SYMBOL SET

RELATED APPLICATIONS

This application claims priority to U.S. patent application Ser. No. 15/976,637 filed on May 10, 2018, entitled "Enhanced Electronic Gaming Machines and Methods for Same Providing Merged Game Matrices with Merged Symbol Set," which claims priority to U.S. Provisional Patent Application No. 62/553,990 filed on Sep. 4, 2017, entitled "A Gaming Machine,", and is a continuation of U.S. Design application Ser. No. 29/616,125 filed Sep. 1, 2017, issued on Jan. 29, 2019, as U.S. Pat. No. D839304, entitled "Display Screen or Portion Thereof with Transitional Graphical User Interface,", which are hereby incorporated by reference herein in their entireties.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

In some electronic gaming machines, a number of reels are spun to form an outcome. Each reel has a number of symbols. The outcome is evaluated based on the symbols spun up. While such gaming machines provide players with enjoyment, a need exists for new gaming systems in order to maintain or increase player enjoyment.

SUMMARY

One embodiment provides a method of merging a plurality of games into a merged game with an increased number of display positions. For example, a gaming machine includes a display that displays a plurality of games. A game controller determines if a wager has been placed, and if the wager placed includes a base game wager and a game enhancement wager. If the wager placed includes a base game wager and a game enhancement wager, the game controller transforms the games into a merged game. The feature game has a number of display positions that is greater than a sum of display positions of the plurality of games.

Another embodiment provides a gaming machine. The gaming machine includes a game controller to initiate a plurality of games, select a plurality of symbols for each of the games, and cause a display to display the selected symbols at display positions of each of the games. The game controller determines if a merging condition is met with respect to two of the games, merges the two of the games and inserts additional symbols between the merged two of the games in response to determining that a merging condition is met. The gaming machine also includes a payout mechanism to cause a payout associated with a win.

DRAWING DESCRIPTIONS

DETAILED DESCRIPTION

Figure 1:
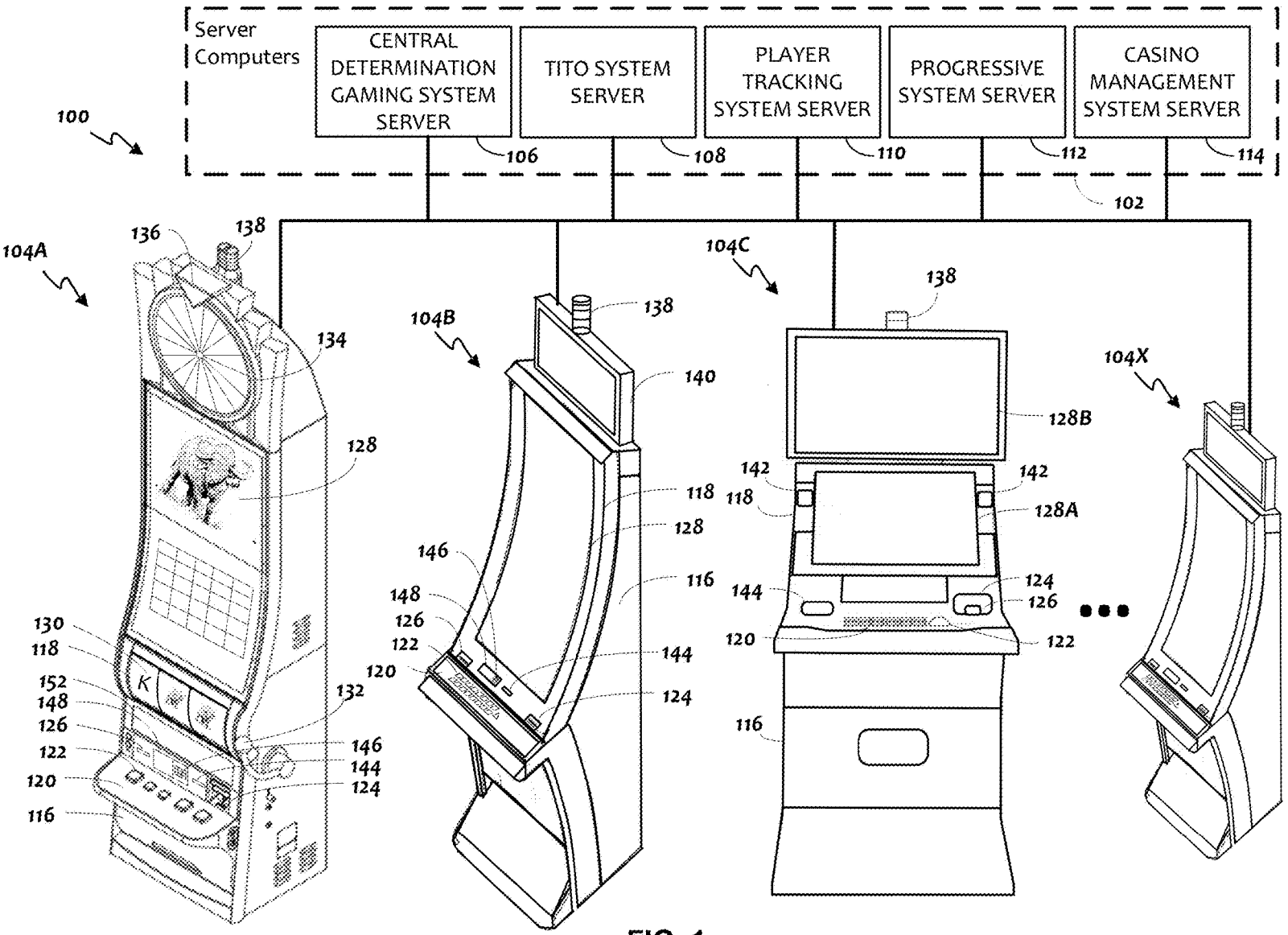
FIG. 1 is an exemplary diagram showing several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console.

Communication between the gaming devices 104A-104X and the server computers 102, and among the gaming devices 104A-104X, may be direct or indirect, such as over the Internet through a web site maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 116 which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 128 comprising a number (typically 3 or 5) of mechanical reels 130 with various symbols displayed on them. The reels 130 are independently spun and stopped to show a set of symbols within the gaming display area 128 which may be used to determine an outcome to the game.

In many configurations, the gaming machine 104A may have a main display 128 (e.g., video display monitor) mounted to, or above, the gaming display area 128. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 118 which may be used to initiate game play.

Figure 2:
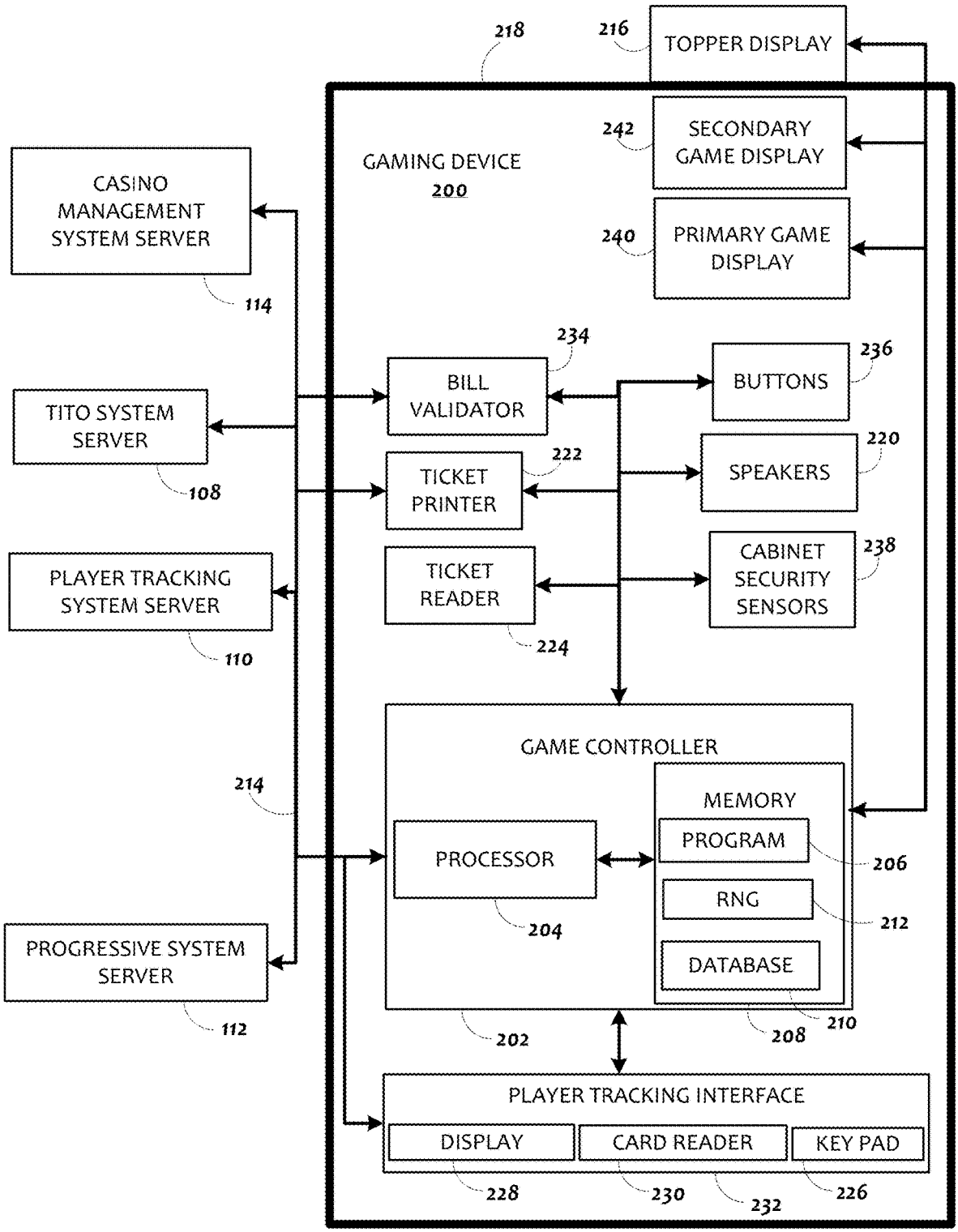
FIG. 2 is a block diagram showing various functional elements of an exemplary EGM.

Many or all the above described components can be controlled by circuitry (e.g., a gaming controller) housed inside the main cabinet 118 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 118 including a main door 116 which opens to provide access to the interior of the gaming device 104B. The main or service door 116 is typically used by service personnel to refill the ticket-out printer 126 and collect bills and tickets inserted into the bill validator 124. The main door 116 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, main display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. For example, a credit meter may display, monitor, and/or indicate a player's credit balance. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202. In some embodiments, the bill validator 234 or the card reader 230 may detect whether a physical item representing a monetary value, such as, a bill or a player tracking card has been received, so as to initiate a wagering activity.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a credit input mechanism, such as a coin acceptor (not shown) or bill validator 234 to establish a credit balance on the gamine machine. The credit balance may be increasable and decreasable based on a wagering activity. In some embodiments, the credit balance is displayed on a credit meter (not shown). In some other embodiments, the credit meter may be stored in the memory 208, and/or the casino management system server 114. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing or actuating a payout mechanism such as a cash-out button to receive a ticket from the ticket printer 222). The ticket may be "cashed-in" for money or inserted into another machine to establish a credit balance for play.

Figure 3A:
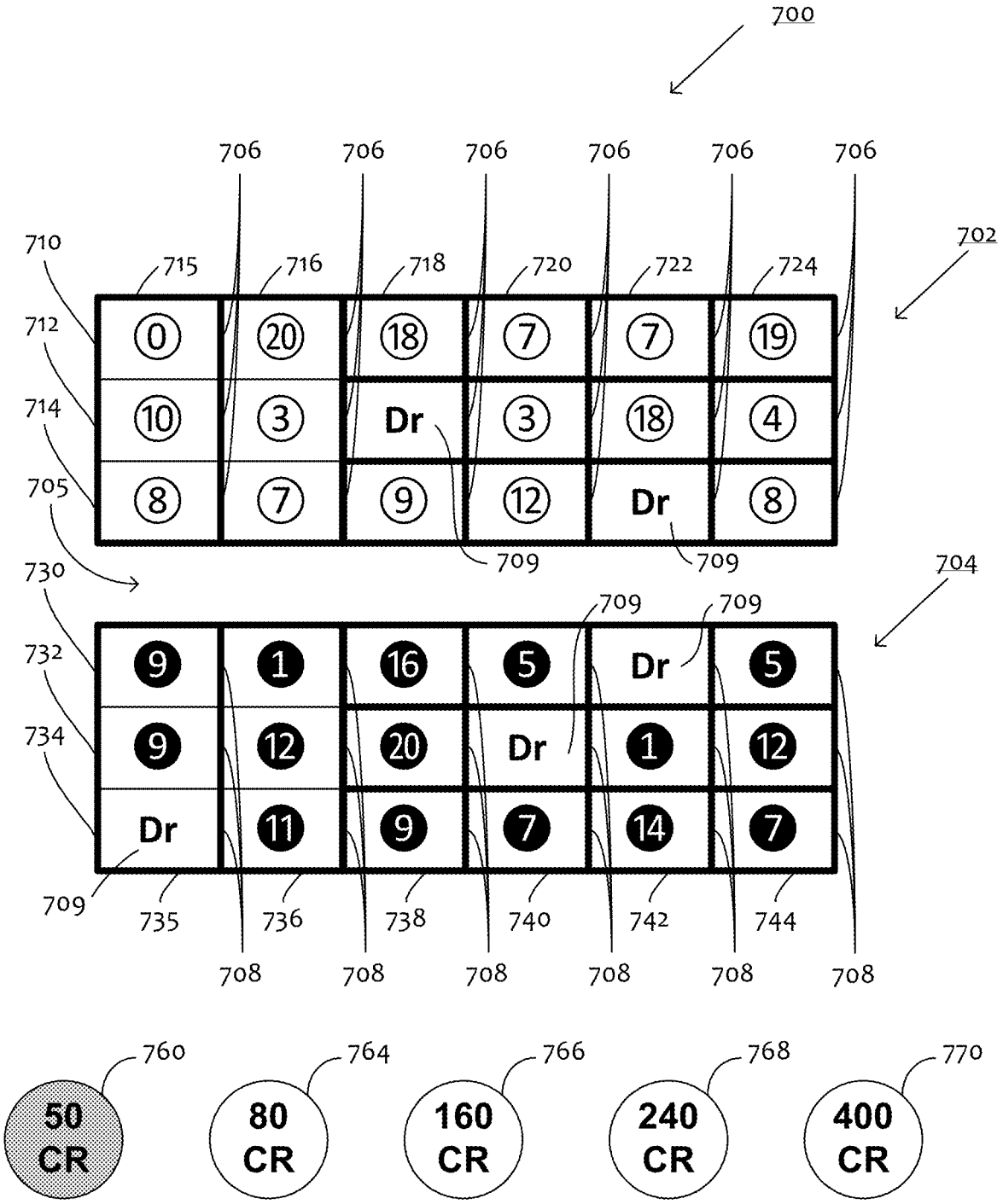
FIG. 3A illustrates a first exemplary game arrangement having two games.

FIG. 3A illustrates a first exemplary game arrangement 700 having two games 702, 704 displayed at the primary game display 240 of FIG. 2. In some embodiments, the first exemplary game arrangement 700 is a feature game triggered by a base game. In some other embodiments, the first exemplary game arrangement 700 is a base game initiated via wagering activity. As shown, game 702 has a first plurality of display positions 706, and plays with a first symbol set. Similarly, game 704 has a second plurality of display positions 708, and plays with a second symbol set. In some embodiments, the first symbol set and the second symbol set share a common symbol, for example, "Dr" symbol 709. In some other embodiments, the first symbol set and the second symbol set are completely different. In still some other embodiments, the first symbol set and the second symbol set are the same.

Referring back to FIG. 3A, game 702 is separated from game 704 by an immersion channel or channel 705. In some embodiments, the channel 705 may be animated in the form of a divider or a barrier that divides game 702 and game 704. In the embodiment shown, game 702 includes a 3×6 matrix of the first plurality of display positions 706 (or three symbols high by six symbols wide, three rows 710, 712, 714, and six columns 715, 716, 718, 720, 722, 724). Also as shown, columns 715, 716 are single reel strips, respectively, and each of which has three display positions. Columns 718, 720, 722, 724 include 12 display positions playing 12 individual spinning reel games. Similarly, game 704 includes a 3×6 matrix of the second plurality of display positions 708 (or three symbols high by six symbols wide, three rows 730, 732, 734, and six columns 735, 736, 738, 740, 742, 744). Also as shown, columns 735, 736 are single reel strips, respectively, each of which has three display positions. Columns 738, 740, 742, 744 include 12 display positions playing 12 individual spinning reel games. In other embodiments, games 702, 704 may have different game sizes. In yet other embodiments, games 702, 704 may include different number of columns, different number of rows, different number of display positions, and/or different games having different number of individual spinning reel games.

As discussed above with respect to FIG. 2, a player may place a wager, initiate a game, or select wager options by selecting one of a plurality of buttons (such as the player-input buttons 236, or touch screen buttons on the primary game display 240). As shown in FIG. 3A, the first exemplary game arrangement 700 also include a first button 760 that represents a base game wager, a second button 764 that represents a base game wager and a first game enhancement wager, a third button 766 that represents a base game wager and a second game enhancement wager, a fourth button 768 that represents a base game wager and a third game enhancement wager, and a fifth button 770 that represents a base game wager and a fourth game enhancement wager. As shown, the first button 760 represents a base game wager of 50 credits, the second button 764 represents an 80-credit wager (which includes a base game wager of 50 credits and a game enhancement wager of 30 credits), the third button 766 represents a 160-credit wager (which includes a base game wager of 50 credits and a game enhancement wager of 110 credits), the fourth button 768 represents a 240-credit wager (which includes a base game wager of 50 credits and a game enhancement wager of 190 credits), and the fifth button 770 represents a 400-credit wager (which includes a base game wager of 50 credits and a game enhancement wager of 350 credits). In some cases, some or all of the second button 764, the third button 766, the fourth button 768, and the fifth button 770, when activated, may provide different game enhancement features, different bonus or wild symbols, improved winning probabilities, and additional merging display positions. For example, when different wagers are offered via the first button 760, the second button 764, the third button 766, the fourth button 768, and the fifth button 770, respectively, a higher wager may result in a different enhanced or merged game than a lower wager does. For example, when the second button 764 (representing an 80-credit wager) is selected, the enhanced or merged game may include one additional display position, but, when the fourth button 770 (representing a 400-credit wager) is selected, the enhanced or merged game includes four additional display positions. Thus, a player may choose to play a base game by selecting the first button 760. Alternatively, a player may choose to play an enhanced or merged game by selecting, for example, the fifth button 770.

Accordingly, when a wager is made via the first button 760, which represents a base game wager, the game controller 202 of FIG. 2 plays a base game represented by games 702, 704. Specifically, as part of the base game, the game controller 202 of FIG. 2 independently selects symbols for games 702, 704 from the first symbol set and the second symbol set, respectively. In such a case, the game controller 202 of FIG. 2 randomly populates the first plurality of display positions 706 with symbols selected from the first symbol set, and separately and randomly populates the second plurality of display positions 708 with symbols selected from the second symbol set, as shown FIG. 3A.

Figure 3B:
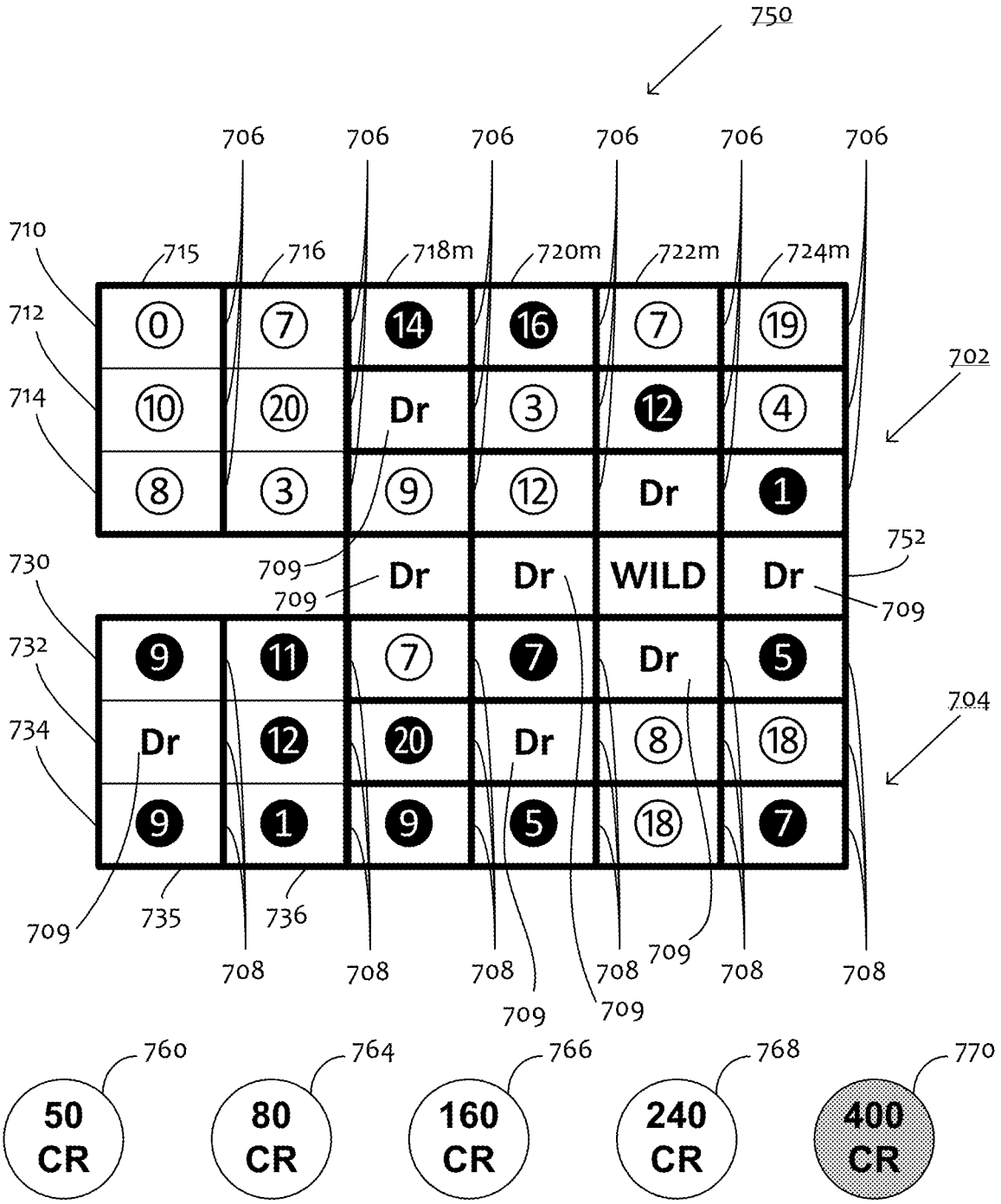
FIG. 3B illustrates an exemplary merged game with an addition group inserted between the two games of FIG. 3A.

However, when a wager is made via the fifth button 770, which includes a base game wager and a game enhancement wager, the game controller 202 of FIG. 2 plays a merged game. FIG. 3B illustrates an exemplary merged game 750 with a plurality of additional display positions 752 replacing a portion of the channel 705 between games 702, 704 of FIG. 3A. That is, when the game controller 202 of FIG. 2 determines that the wager also includes a game enhancement wager (additional to the base game wager), the game controller 202 of FIG. 2 signals the primary game display 240 of FIG. 2 to animate a merging of games 702, 704 with the plurality of additional display positions 752 in the channel 705. As shown in FIG. 3B, animating a merging of games 702, 704 with the additional display positions 752 results in the merged game 750, which has a 7×4 matrix of display positions, and includes rows 710, 712, 714, 730, 732, 734, the plurality of additional display positions 752, and four merged columns 718*m*, 720*m*, 722*m*, 724*m*. FIG. 3B also shows that game 702 and game 704 have not merged at columns 715, 716. As shown, the merged game includes a plurality of contiguous display positions formed from at least a portion of the first plurality of display positions 706, at least a portion of the second plurality of display positions 708, and the additional display positions 752. Further, FIG. 3B shows that columns 715, 716 of game 702 remain individual games, respectively, and, similarly, columns 735, 736 of game 704 also remain individual games, respectively. In other embodiments, all columns of game 702 and game 704 merge into a merged game.

In some embodiments, after merging games 702, 704, the game controller 202 of FIG. 2 continues to play the games 702, 704 separately and individually, while the additional display positions 752 are being populated with symbols from a special symbol set. For example, the game controller 202 of FIG. 2 randomly populates the additional display positions 752 with symbols from a special symbol set, before populating each of the first plurality of display positions 706 and the second plurality of display positions 708 with symbols. In some embodiments, the special symbol set may include wild symbols only. In some embodiments, a wild symbol may substitute for other symbols to potentially form a winning outcome in a game. In some other embodiments, the special symbol set may include wild symbols and the common symbol, for example, the "Dr" symbol 709. In still other embodiments, the special symbol set may include wild symbols, the common symbol, for example, the "Dr" symbol 709, and other predetermined symbols. As shown in FIG. 3B, the game controller 202 populates the plurality of additional display positions 752 with wild symbols from the special symbols set that also includes the "Dr" symbol 709, while separately spinning to populate the first plurality of display positions and the second plurality of display positions of games 702, 704. In some other embodiments, the special symbol set may include wild symbols, the "Dr" symbol 709, and other predetermined symbols. In some other embodiments, the game controller 202 may spin the additional display positions and games 702, 704 concurrently.

In some embodiments, when games 702, 704 are merged into the merged game, the game controller 202 also merges the first symbol set and the second symbol set into a merged symbol set. The merged game selects symbols from the merge symbol set for the first plurality of display positions 706, the second plurality of display positions 708, and the plurality of additional display positions 752. That is, the plurality of additional display positions 752 may also display symbols from the first symbol set or the second symbol set. In such cases, the game controller 202 plays the merged game as a whole. Thus, in embodiments where the first symbol set and the second symbol set include common wild symbols, the merged game may have higher chances of selecting a wild symbol from the merged symbol set.

In some other embodiments, when games 702, 704 are merged into the merged game, the game controller 202 also merges the first symbol set and the second symbol set into a merged symbol set. However, the merged game selects symbols from the merge symbol set only for the first plurality of display positions 706 and the second plurality of display positions 708, while selecting symbols for the additional display positions 752 differently. In such cases, the game controller 202 selects symbols from the special symbol set for display at the plurality of additional display positions 752, as discussed above.

In still other embodiments, when games 702, 704 are merged into the merged game, the game controller 202 continues to use the first symbol set only for game 702, and the second symbol set for game 704. In such cases, the merged game does not use a merged symbol set. Thus, the merged game has a matrix size of 7×4 display positions, plus four individual reels or columns 715, 716, 735, 736, and selects symbols from the special symbol set for display at the plurality of additional display positions 752, as discussed above.

Figure 4A:
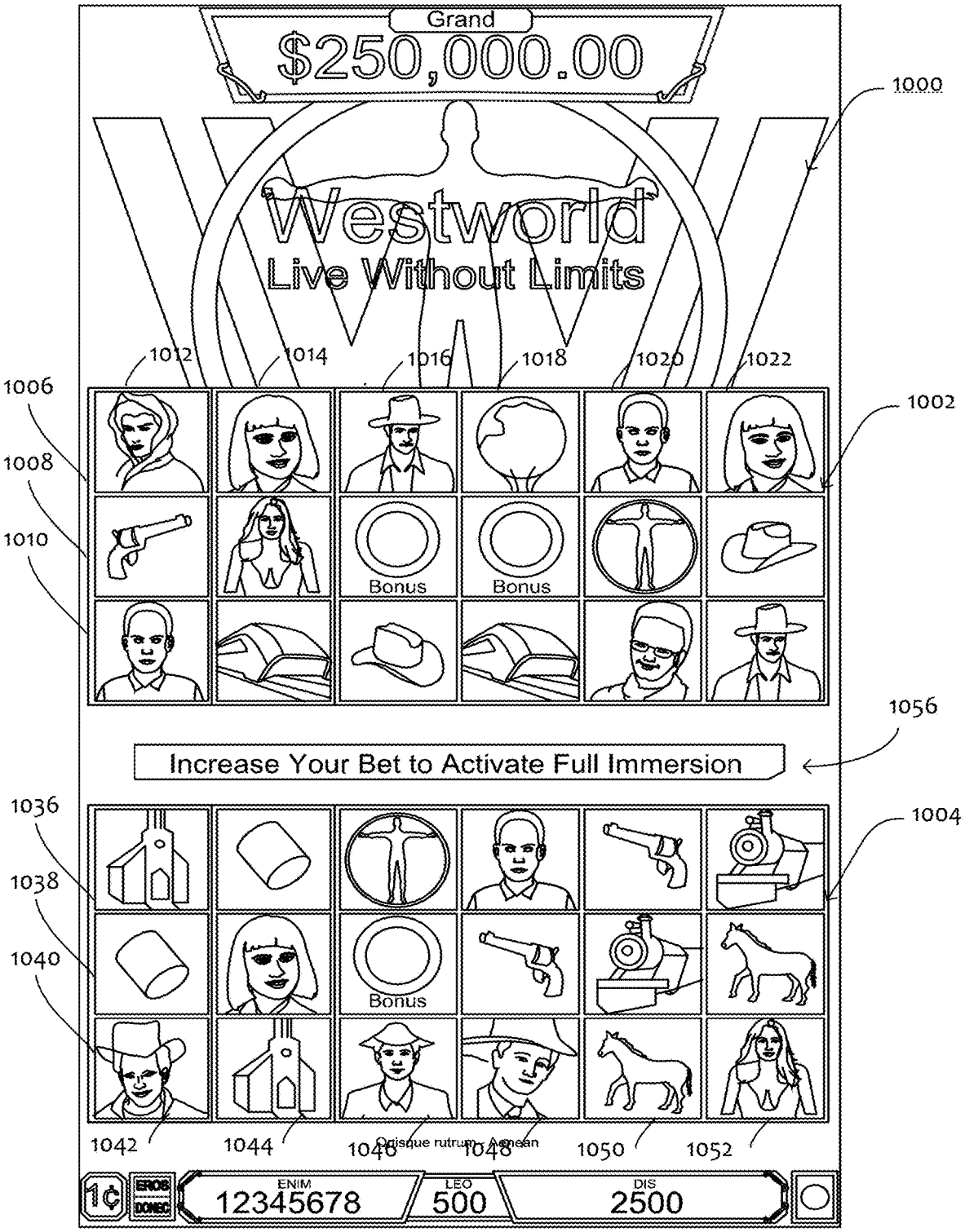
FIG. 4A illustrates a second exemplary game arrangement having two games.

FIG. 4A illustrates a second exemplary game arrangement 1000 having a first game instance 1002 and a second game instance 1004 in the form of the Westworld™ game. (Westworld is a trademark of Warner Brothers Entertainment Inc.). Specifically, FIG. 4A shows that the first game instance 1002 includes a 3×6 matrix of display positions. As shown, columns 1012 and 1014 are individual reels. Each of the columns 1012 and 1014 has three display positions, a 3×1 matrix of display positions. The 3×6 matrix also includes a 3×4 matrix of display positions, which includes rows 1006, 1008, 1010, and columns 1016, 1018, 1020, 1022. The first game instance 1002 includes a first set of symbols. Similarly, the second game instance 1004 includes a 3×6 matrix of display positions. As shown, columns 1042 and 1044 are individual reels. Each of the columns 1042 and 1044 has three display positions, a 3×1 matrix of display positions. The 3×6 matrix also includes a 3×4 matrix of display positions, which includes rows 1036, 1038, 1040, and columns 1046, 1048, 1050, 1052. The second game instance 1004 uses a second set of symbols. The first game instance 1002 is separated from the second game instance 1004 by a channel 1056.

In some embodiments, the first set of symbols and the second set of symbols are different. However, the first symbol set and the symbol set may share one or more symbols in common. For example, the first symbol set and the second symbol set may share a wild symbol and/or a predetermined symbol.

Figure 4B:
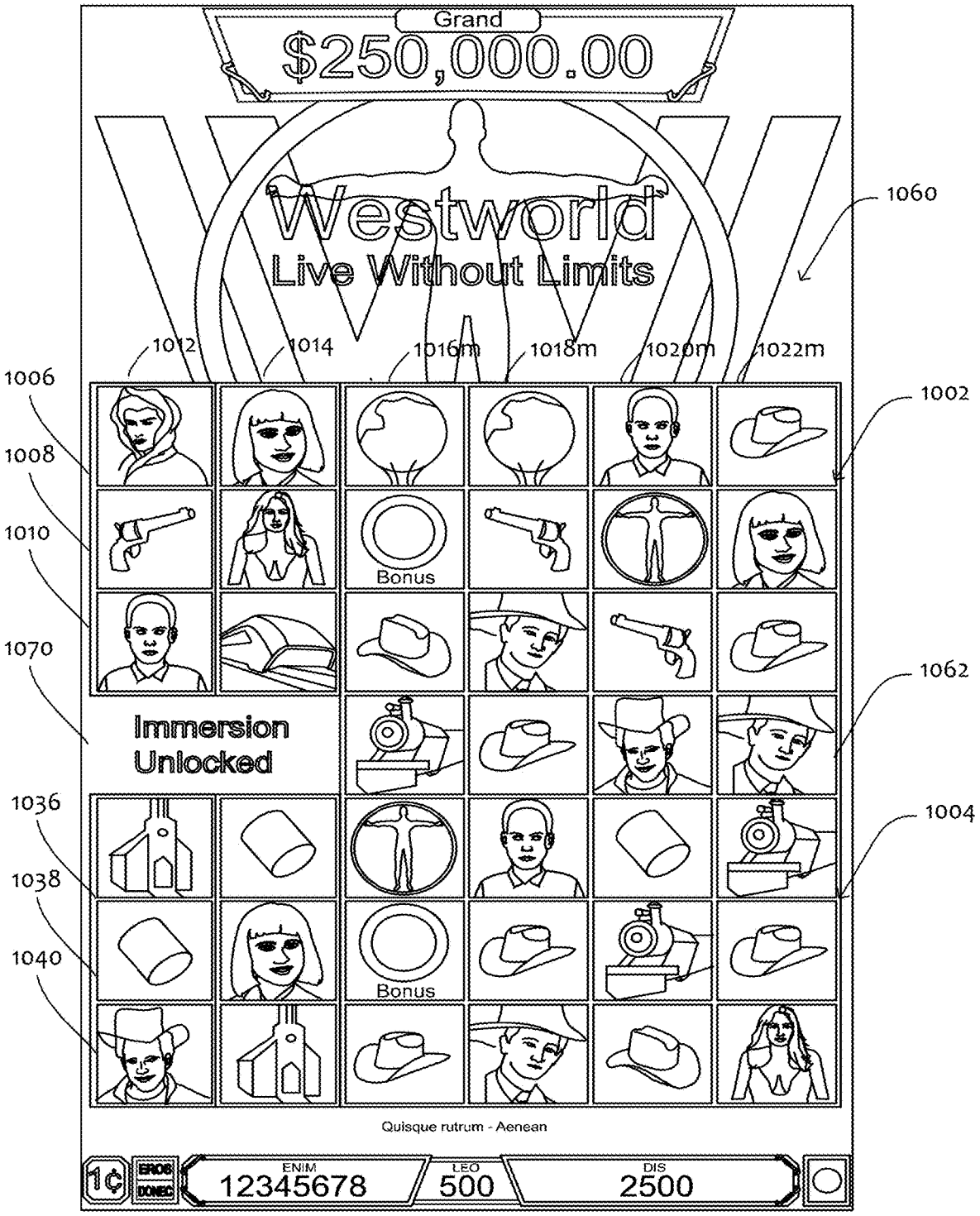
FIG. 4B illustrates a second exemplary merged game with an additional group inserted between the two games of FIG. 4A.

FIG. 4B illustrates a second exemplary merged game instance 1060 with a group of additional display positions 1062 inserted between the first game instance 1002 and the second game instance 1004 of FIG. 4A. Specifically, FIG. 4B illustrates that, when the game controller 202 of FIG. 2 determines that a wager has been made, and the wager made includes a game enhancement wager, the game controller 202 merges the first game instance 1002 and the second game instance 1004 with a group of additional display positions 1062. FIG. 4B also shows symbols have been selected for display at the group of additional display positions 1062 between first game instance 1002 and second game instance 1004. In this way, the merged game 1060 has a 7×4 matrix of display positions, which includes rows 1006, 1008, 1010, 1070, 1036, 1038, 1040, and merged columns 1016*m*, 1018*m*, 1020*m*, 1022*m*.

When the wager includes a base game wager and a game enhancement wager, the game controller 202 of FIG. 2 merges first game instance 1002 and second game instance 1004 into a merged game instance. In some embodiments, after merging first game instance 1002 and second game instance 1004, the game controller 202 plays the merged game 1060 as a single game. For example, the game controller 202 initially merges the first symbol set with the second symbol set, and randomly populates each display position in the merged columns 1016*m*, 1018*m*, 1020*m*, and 1022*m* with symbols from the merged symbol set. In some other embodiments, after merging first game instance 1002 and second game instance 1004, the game controller 202 of FIG. 2 continues to play first game instance 1002 and second game instance 1004 separately and individually, while the additional display positions 1062 are being populated with symbols from a special symbol set.

Figure 5A:
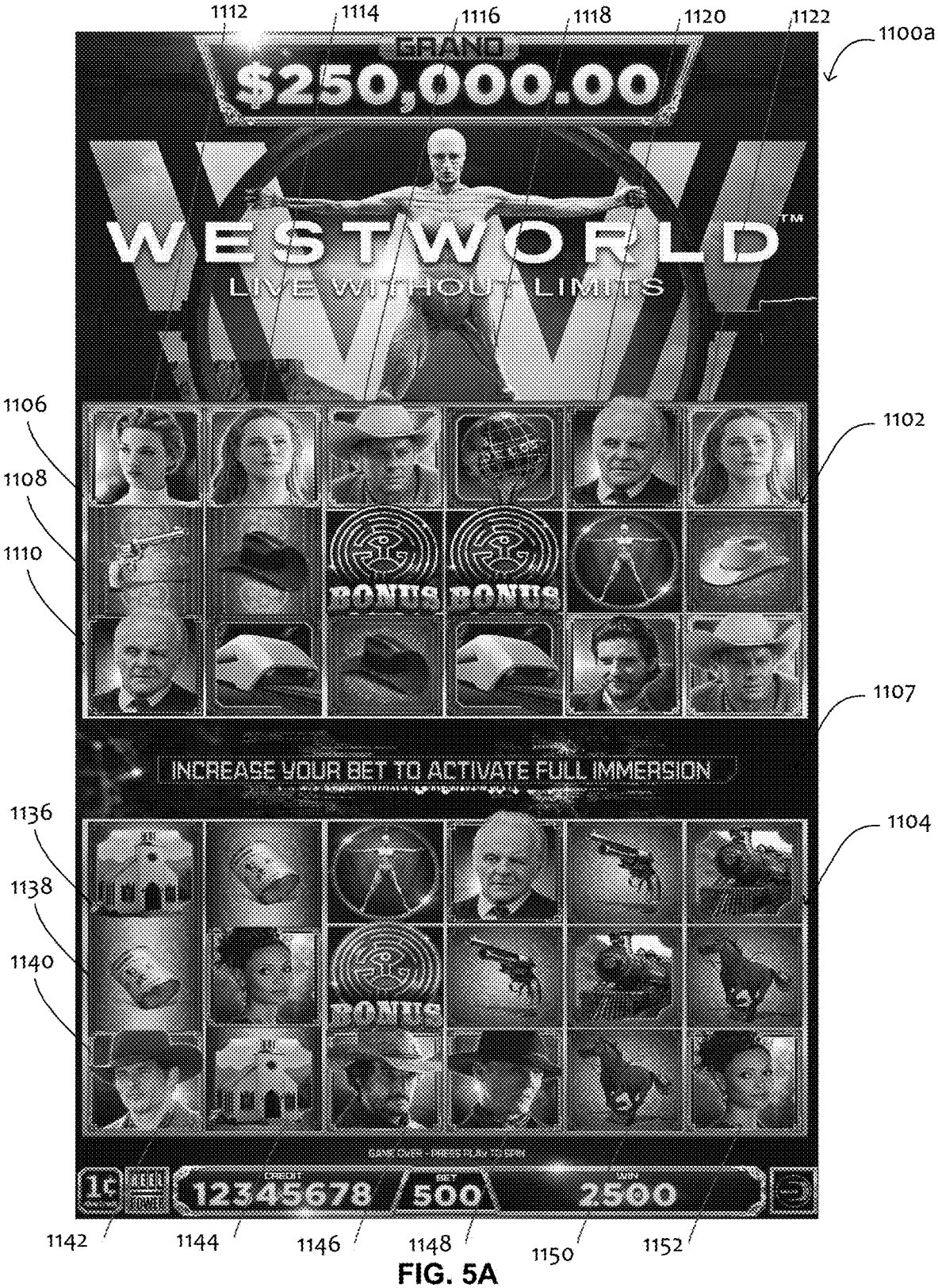
FIG. 5A illustrates an exemplary screenshot of two games of FIG. 4A.

FIG. 5A illustrates an exemplary screenshot of a game arrangement 1100*a* having first game instance 1102 and second game instance 1104 (similar to first game instance 1002 and second game instance 1004 of FIG. 4A) with two different symbol sets with a channel 1107 between first game instance 1102 and second game instance 1104. Before merging, first game instance 1102 includes reels 1112, 1114, which are respective single reel strips, and columns 1116, 1118, 1120, 1122, which include 12 individual reels. Similarly, second game instance 1104 includes reels 1142, 1144, which are respective single reel strips, and columns 1146, 1148, 1150, 1152, which include 12 individual reels. First game instance 1102 and second game instance 1104 have first symbol set and second symbol set, respectively. In the embodiment shown, first game instance 1102 and second game instance 1104 also share a wild symbol and a predetermined character or symbol (e.g., symbol for a "Dr. Ford" character).

Figure 5B:
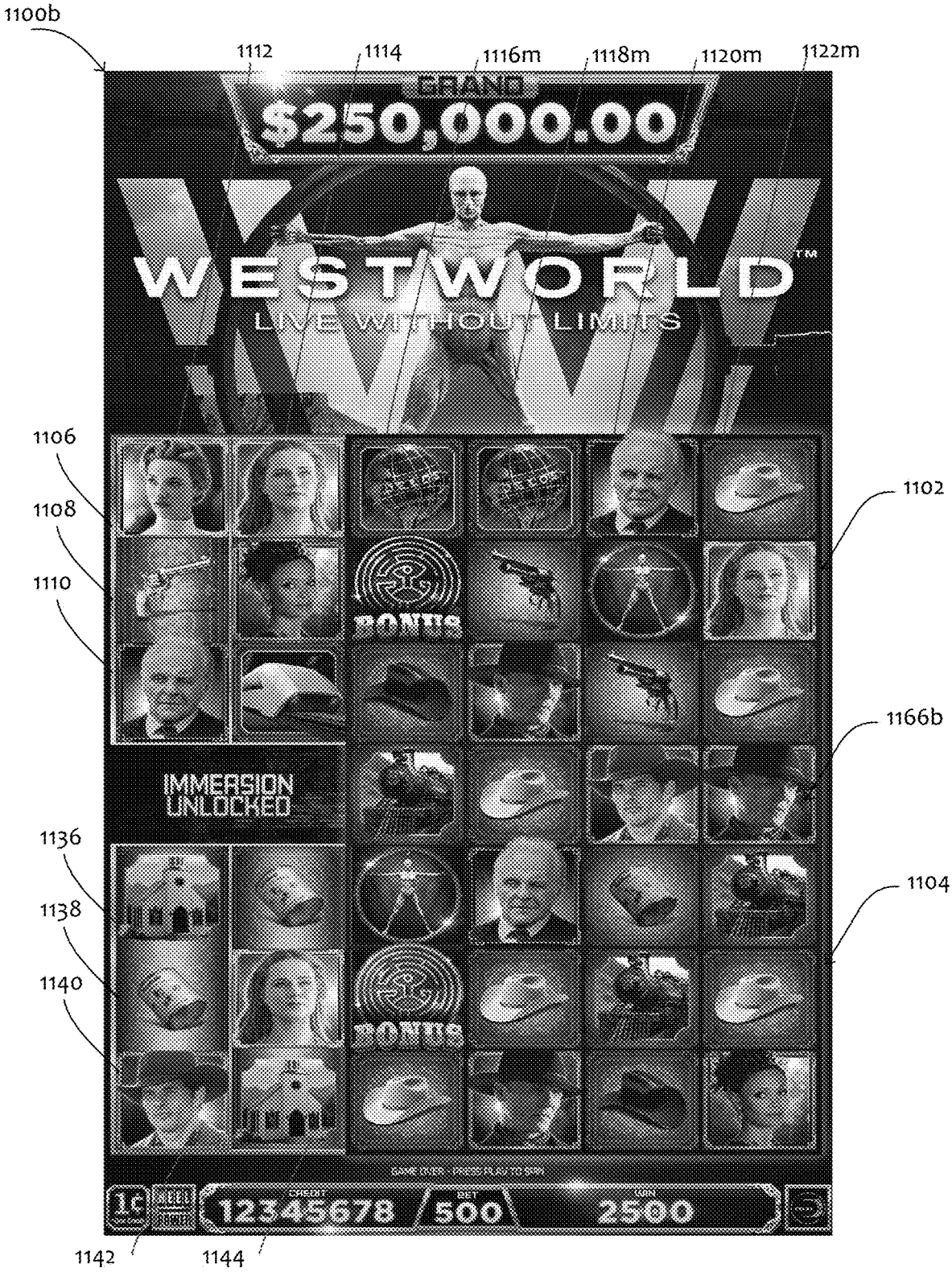
FIG. 5B illustrates an exemplary screenshot of a first merged game with an additional group inserted between the two games of FIG. 5A.

FIG. 5B illustrates an exemplary screenshot of a first merged game 1100*b* with an additional group of reels or display positions 1166*b* inserted between the games of FIG. 5A. FIG. 5B shows that, when an additional wager is made, first game instance 1102 and second game instance 1104 merge into a merged game, and the additional group of reels or display positions 1166 is inserted in the channel 1107 between first game instance 1102 and second game instance 1104. After merging, reels 1112, 1114 of first game instance 1102 continue to only contain symbols from the first set of symbols including the wild symbol and the predetermined character or symbol. Similarly, reels 1142, 1144 of second game instance 1104 also continue to only contain symbols from the second set of symbols including the wild symbol and the predetermined character or symbol. FIG. 5B also shows that, the 28 individual reels in columns 1116, 1118, 1120, 1122 may contain symbols from a merged symbol set that includes symbols from both the first symbol set and the second symbol set plus the wild symbol and the predetermined character or symbol. The symbols in the merged symbol set are selected for all win evaluations in the merge game. An advantage to a player lies in both the addition of the four additional reels or display positions in the channel 1107, and that the wild symbol and the predetermined character or symbol can contribute to pays in both the first symbol set and second symbol set.

Figure 5C:
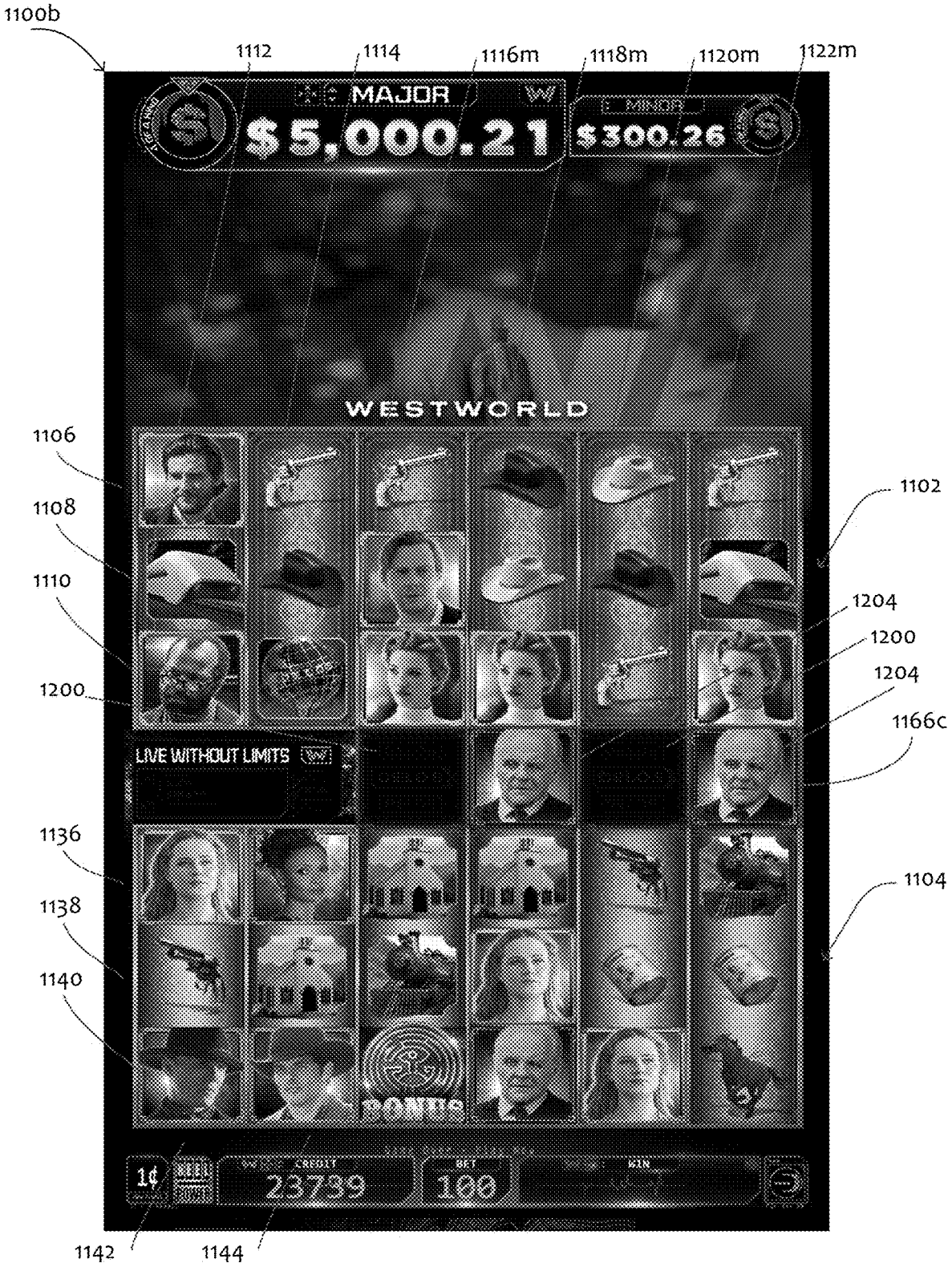
FIG. 5C illustrates an exemplary screenshot of a second merged game with an additional group inserted between the two games of FIG. 5A.

FIG. 5C illustrates an exemplary screenshot of a second merged game 1100*c* with an additional group 1166*c*. In this embodiment, the second merged game 1100*c* does not use a merged symbol set. That is, first game instance 1102 and second game instance 1104 continue to use the first symbol set and the second set, respectively, while the additional group 1166*c* plays with a special symbol set. As shown, the special symbol set includes a blank symbol 1200 and a predetermined character symbol 1204. In this embodiment, the predetermined character symbol 1204 is the character "Dr. Ford" in the TV show Westworld™.

Figure 5D:
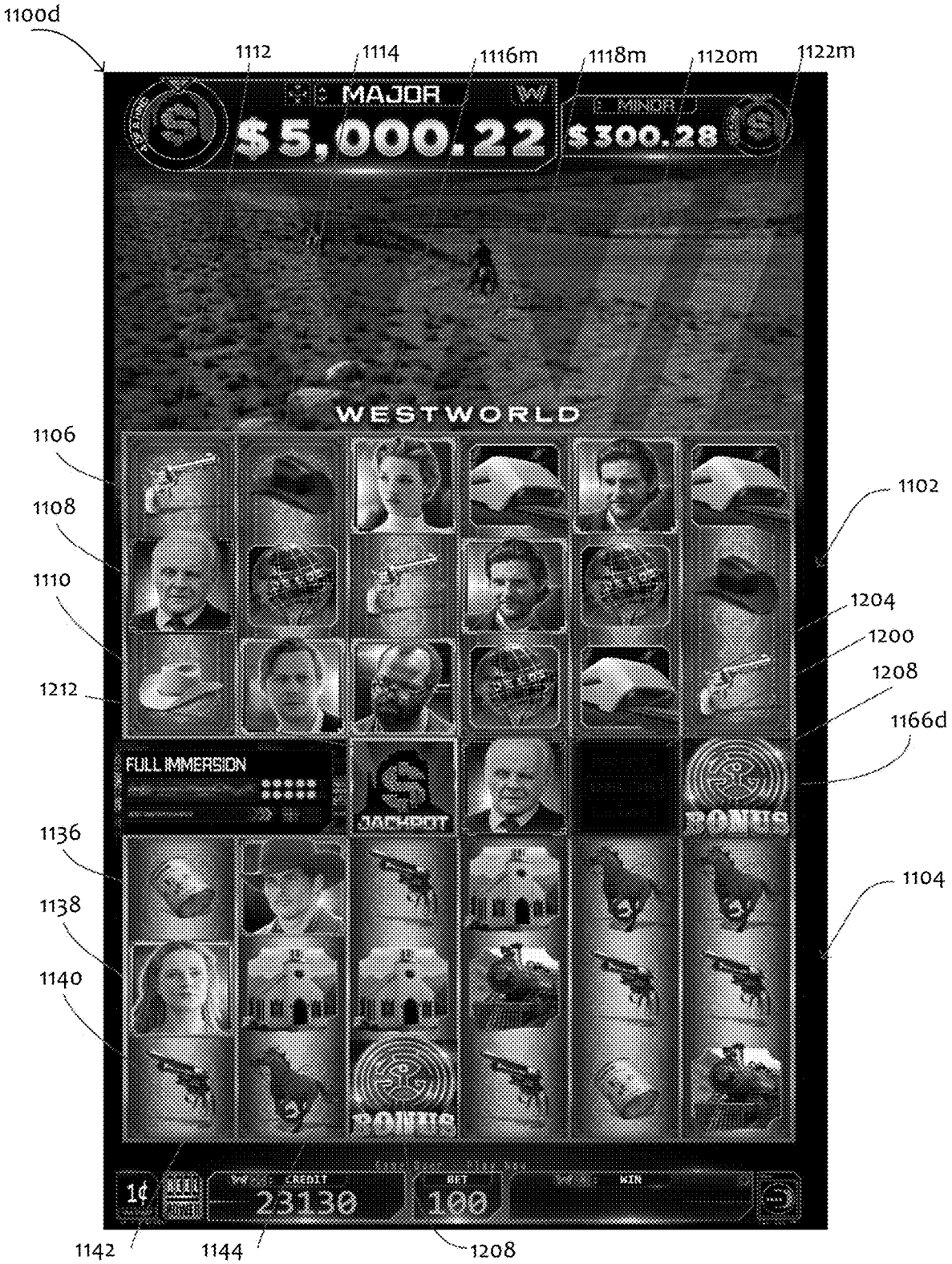
FIG. 5D illustrates an exemplary screenshot of a third merged game with an additional group inserted between the two games of FIG. 5A.

FIG. 5D illustrates an exemplary screenshot of a third merged game 1100*d* with an additional group 1166*d*. In this embodiment, the third merged game 1100*d* does not use a merged symbol set. That is, first game instance 1102 and second game instance 1104 continue to use the first symbol set and the second set, respectively, while the additional group 1166*d* plays with a special symbol set that includes one or more symbols from the first symbol set and the second symbol set. For example, in the embodiment shown, the special symbol set includes a bonus symbol 1208 from the second symbol set, and a Jackpot symbol 1212. In some embodiments, each of the first symbol set and the second symbol set includes one or more bonus symbols, respectively. In such cases, the one or more bonus symbols may be ranked higher than other symbols in the first symbol set and the second symbol set, respectively. As shown, the additional group 1166*d* displays a blank symbol 1200, the predetermined character symbol 1204 (the Dr. Ford character), the bonus symbol 1208, and the Jackpot symbol 1212. In some embodiments, the one or more bonus symbols in the first symbol set and the one or more bonus symbols in the second symbol set are different.

Figure 5E:
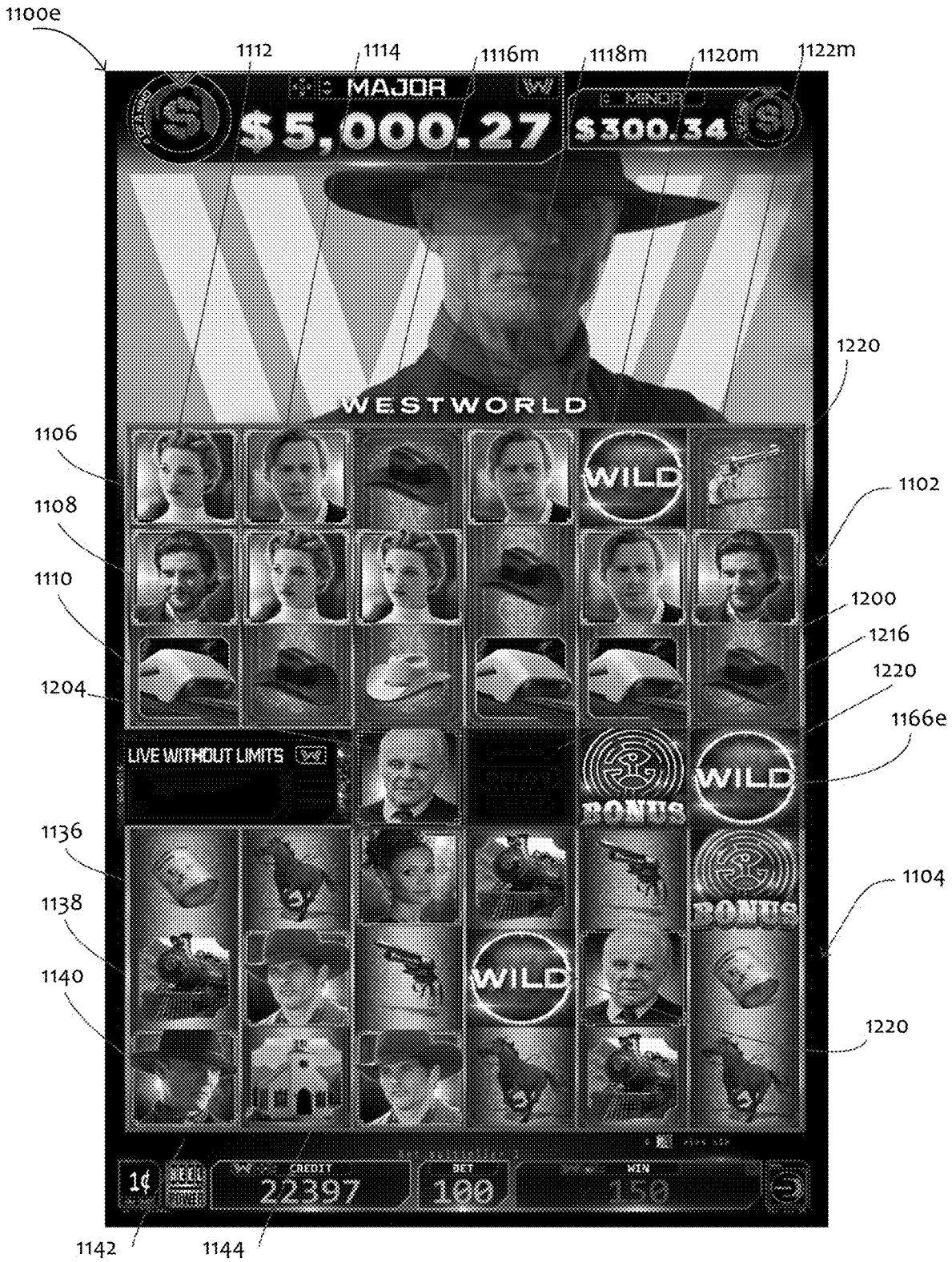
FIG. 5E illustrates an exemplary screenshot of a fourth merged game with an additional group inserted between the two games of FIG. 5A.

FIG. 5E illustrates an exemplary screenshot of a fourth merged game 1100*e* with an additional group 1166*e*. In this embodiment, the fourth merged game 1100*e* does not use a merged symbol set. However, the additional group 1166*e* plays with a special symbol set that may include one or more symbols from the first symbol set and the second symbol set. For example, in the embodiment shown, the special symbol set includes a bonus symbol 1216 from the first symbol set and a different common symbol in the form of a wild symbol 1220. As shown, the additional group 1166*d* displays a predetermined character symbol 1204, a blank symbol 1200, a bonus symbol 1216, and a wild symbol 1220.

Figure 5F:
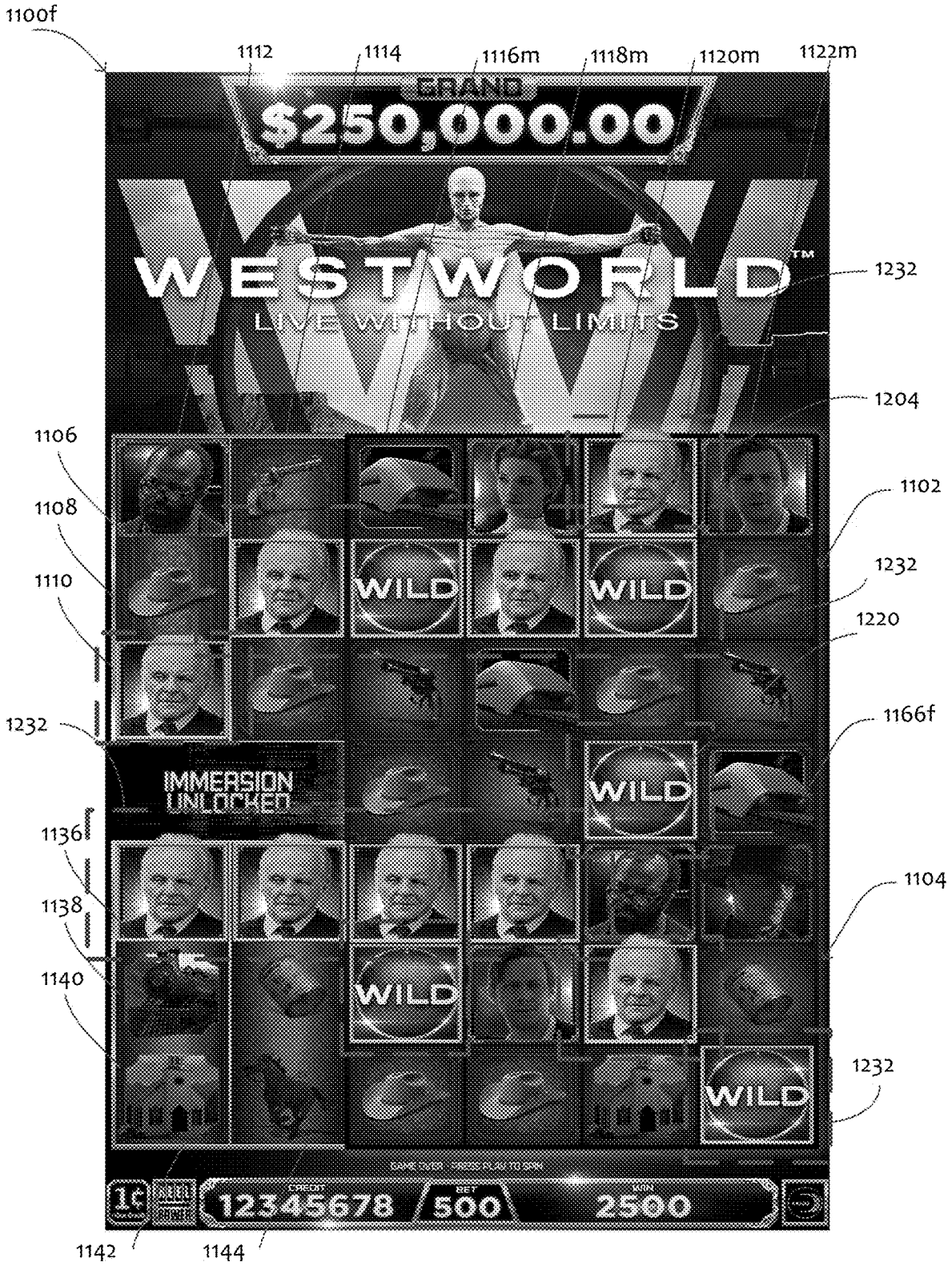
FIG. 5F illustrates an exemplary screenshot of a fifth merged game with an additional group inserted between the two games of FIG. 5A.

FIG. 5F illustrates an exemplary screenshot of a fifth merged game 1100*f* with an additional group 1166*f*. In this embodiment, the fifth merged game 1100*f* merges the first symbol set with the second symbol set into a merged symbol set. Further, the additional group 1166*f* also plays with the merged symbol set. That is, the fifth merged game 1100*f*, which includes the first plurality of display positions, the second plurality of display positions, and the additional group 1166*f* of display positions, selects symbols from the merged symbol set. As shown, the fifth merged game 1100*f* highlights a winning outcome 1232 that includes a number of the wild symbol 1220 and a number of the predetermined character symbol 1204, while de-emphasizing the remaining displayed symbols.

Figure 6A:
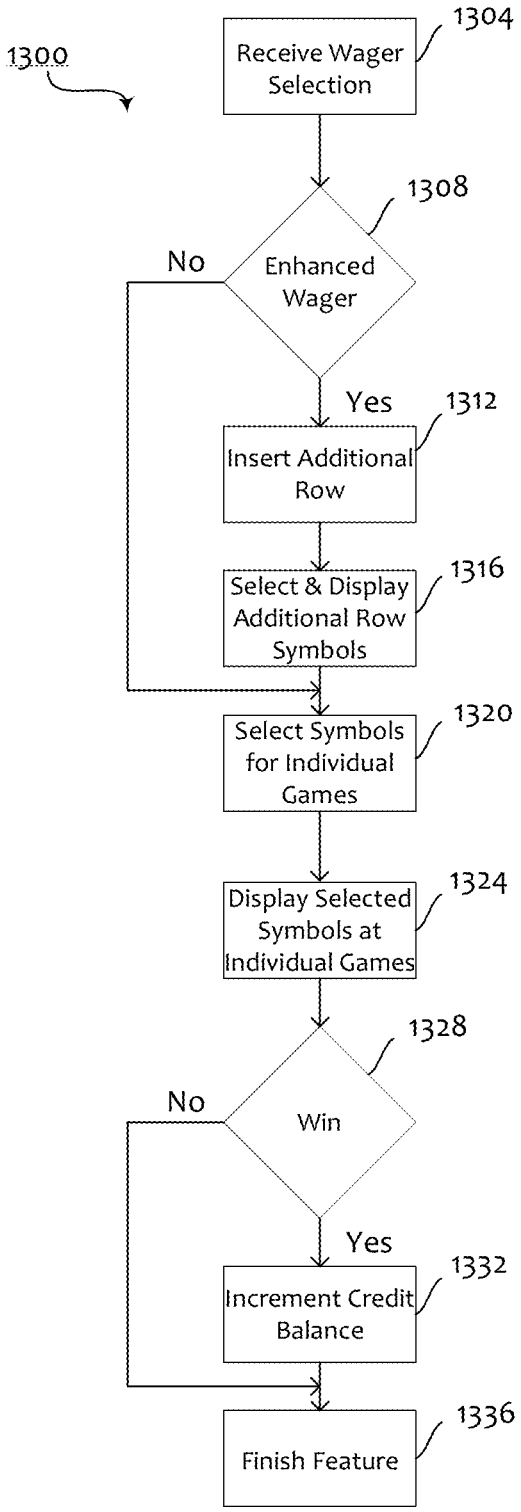
FIG. 6A illustrates a flow chart of a first game merging process.

FIG. 6A illustrates a flow chart of a first game merging process 1300. In this embodiment, a display displays a first game with a first symbol set at a first plurality of display positions, and a second game with a second symbol set at a second plurality of display positions. The first symbol set and the second symbol set may share a plurality of common symbols, such as a wild symbol and a special symbol, for example, the predetermined character symbol 1204 (the Dr. Ford character) of FIG. 5C, as discussed above.

Referring back to FIG. 6A, at block 1304, the game controller 202 of FIG. 2 determines if a wager has been placed, for example, via the first button 760 or the fifth button 770, of FIG. 3A. At block 1308, the game controller 202 determines if the wager placed includes a game enhancement wager, as discussed above with respect to FIG. 3A and FIG. 3B. If the wager placed only includes a base game wager, but not a game enhancement wager, the first game merging process 1300 proceeds to block 1320. However, if the wager placed includes a based game wager and a game enhancement wager, the first game merging process 1300 proceeds to block 1312 to play a merged game. As part of a merged game, at block 1312, the first game merging process 1300 proceeds to insert the plurality of additional display positions between the first plurality of display positions and the second plurality of display positions, thereby forming a merged game from the first plurality of display positions of the first game, the second plurality of display positions of the second game, and the plurality of additional display positions. At block 1316, when merging of the first game and the second game occurs, the game controller 202 of FIG. 2 selects symbols from the special symbol set for display at the plurality of additional display positions.

At block 1320, the game controller 202 proceeds to select symbols from the first symbol set for display at the first plurality of display positions, and to select symbols from the second symbol set for display at the second plurality of display positions. Thus, in this embodiment, the first symbol set and the second symbol set do not merge. As a result, the game controller 202 plays the first game independently from the second game, and from the plurality of additional display positions.

At block 1324, the display displays the symbols selected for the first game and the second game, respectively. Thus, in this embodiment, symbols for the plurality of additional display positions are selected before symbols for the first game and the second game are selected.

In block 1328, the game controller 202 determines if the symbols selected include one or more winning outcomes. In some embodiments, the game controller 202 may use Reel Power® logic to evaluate symbols at the display positions 706 or 708 for wins. That is, all wins begin with column 716 for game 702, and column 736 for game 704, and pay left to right on adjacent reel columns only, except for scatter symbols. Winning symbols can occur anywhere on all reels. At block 1332, if the game controller 202 determines that the symbols selected include one or more winning outcomes, the game controller 202 increases the credit balance on the credit meter. In some embodiments, increasing the credit balance on the credit meter may be depicted on the display. The first game merging process 1300 finishes at block 1336.

Figure 6B:
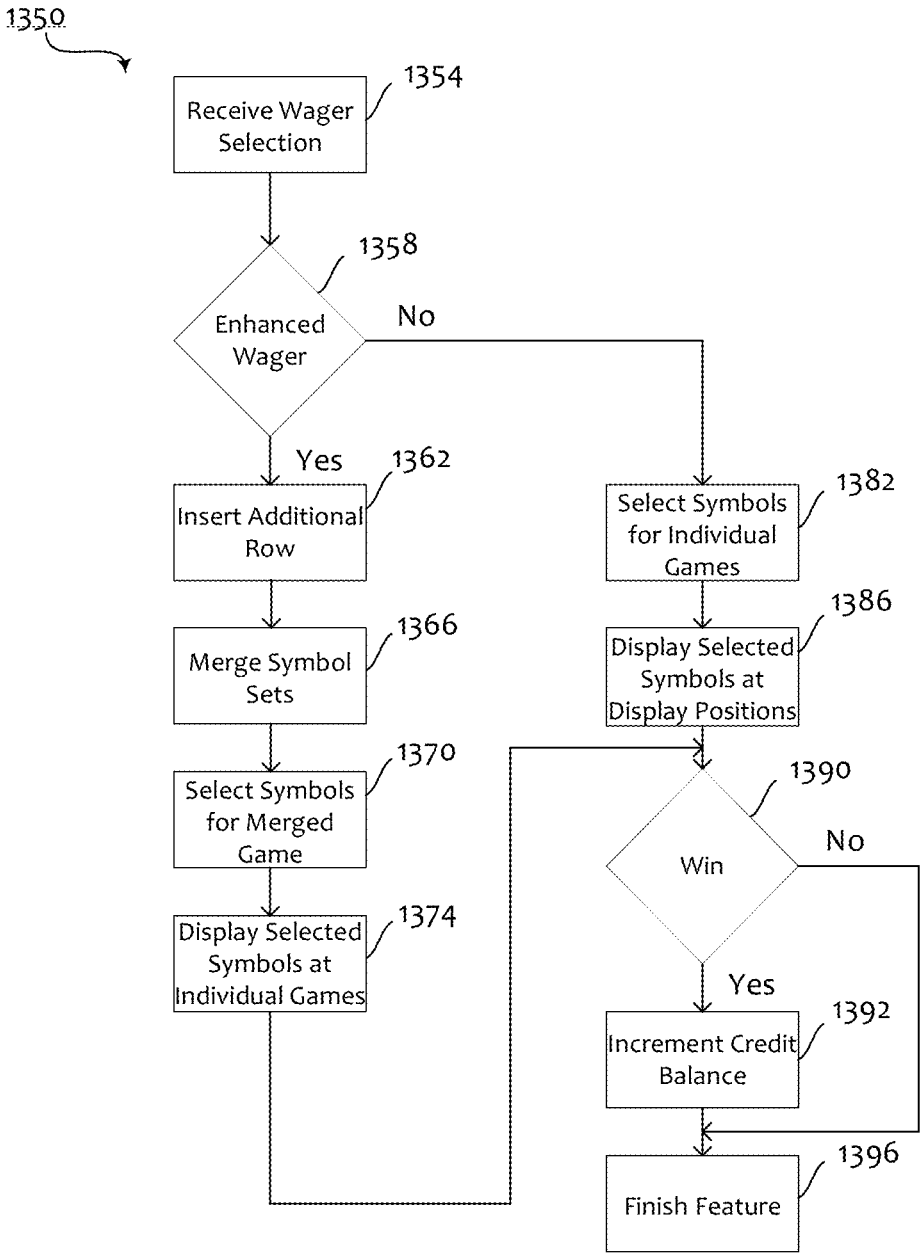
FIG. 6B illustrates a flow chart of a second game merging process.

FIG. 6B illustrates a flow chart of an alternate game merging process 1350. In this embodiment, a display displays a first game with a first symbol set at a first plurality of display positions, and a second game with a second symbol set at a second plurality of display positions. The first symbol set and the second symbol set may share a plurality of common symbols, such as a wild symbol and a special symbol, for example, the predetermined character symbol 1204 (the Dr. Ford character) of FIG. 5C, as discussed above.

Referring back to FIG. 6B, at block 1354, the game controller 202 of FIG. 2 determines if a wager has been placed, for example, via the first button 760 or the fifth button 770, of FIG. 3A. At block 1358, the game controller 202 determines if the wager placed includes a game enhancement wager. If the wager placed does not include a game enhancement wager, the alternate game merging process 1350 proceeds to block 1382 to separately select symbols from the first symbol set for the first plurality of display positions of the first game, and from the second symbol set for the second plurality of display positions of the second game, respectively. The symbols selected for the first game and for the second game are displayed at the first plurality of display positions, and the second plurality of display positions, respectively, at block 1386.

However, if the wager placed includes a game enhancement wager, the alternate game merging process 1350 proceeds to block 1362 to display the plurality of additional display positions between the first game and the second game to form a merged game. At block 1366, the game controller 202 merges the first symbol set and the second symbol set to form a merged symbol set for use with the merged game. At block 1370, the game controller 202 selects symbols for display at the merged game. At block 1374, the display displays the symbols selected at the first plurality of display positions, the second plurality of display positions, and the plurality of additional display positions.

In some other embodiments, at block 1366, the game controller 202 merges the first symbol set and the second symbol set to form a merged symbol set for use with the merged game except for the plurality of additional display positions. At block 1370, the game controller 202 selects symbols for display at the merged game except for the plurality of additional display positions from the merged symbol set. In such cases, the game controller 202 also selects symbols for display at the plurality of additional display positions, at block 1374.

In block 1390, the game controller 202 determines if the symbols selected include one or more winning outcomes. At block 1392, if the game controller 202 determines that the symbols selected include one or more winning outcomes, the game controller 202 may increase the credit balance on the credit meter. The alternate game merging process 1350 finishes at block 1396.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

The invention claimed is:

1. A non-transitory computer-readable medium, readable by at least one processor, and comprising instructions stored thereon to cause the at least one processor to:

generate a first game instance that includes a first set of reel strips with a first set of symbols, and a second game instance that includes a second set of reel strips with a second set of symbols that differs from the first set of symbols;

generate, for a first spin, a first random based game outcome for the first game instance and a second random based game outcome for the second game instance, wherein the first random based game outcome and the second random based game outcome are separate outcomes;

activate a third set of reel strips based on a received user input, wherein the third set of reel strips differs from the first set of reel strips or the second set of reel strips;

generate a merged game instance that includes a merged set of reel strips with at least a portion of the first set of reel strips, at least a portion of the second set of reel strips, and the third set of reel strips;

generate, for a second spin, a merged random based game outcome with the merged set of reel strips; and evaluate whether the merged random based game outcome includes a winning outcome.

2. The non-transitory computer-readable medium of claim 1, wherein, during the merged game instance, the instructions, when executed, further cause the at least one processor to independently select symbols from the first set of symbols for the first game instance, and symbols from the second set of symbols for the second game instance, respectively.

3. The non-transitory computer-readable medium of claim 2, wherein, in the merged game instance, the instructions, when executed, further cause the at least one processor to select symbols from a set of special symbols that includes one or more common symbols shared between the first set of symbols and the second set of symbols.

4. The non-transitory computer-readable medium of claim 1, wherein the third set of reel strips includes a plurality of common symbols shared between the first set of symbols and the second set of symbols.

5. The non-transitory computer-readable medium of claim 1, wherein the first set of reel strips includes a plurality of first wild symbols, and the second set of reel strips includes a plurality of second wild symbols, and wherein the third set of reel strips includes only the first wild symbols and the second wild symbols.

6. The non-transitory computer-readable medium of claim 1, wherein the instructions, when executed, further cause the at least one processor to provide a different number of reel strips in the third set of reel strips when the merged game instance is activated differently.

7. The non-transitory computer-readable medium of claim 1, and wherein during the merged game instance, the instructions, when executed, further cause the at least one processor to select from the first set of symbols and the second set of symbols into a merged set of symbols, and to select symbols for the third set of reel strips from the merged set of symbols.

8. The non-transitory computer-readable medium of claim 1, and wherein during the merged game instance, the instructions, when executed, further cause the at least one processor to merge the first set of symbols and the second set of symbols into a merged set of symbols, to select symbols for the first game instance and the second game instance, and to select symbols for the third set of reel strips from a set of special symbols.

9. A method of operating a feature game on a gaming machine having an interface, and a game controller having a processor and a memory storing instructions, which, when executed, cause the processor to activate the interface, the method comprising:

generating, via the game controller, a first game instance formed from a first set of reel strips with a first symbol set, and a second game instance formed from a second set of reel strips with a second symbol set;

generating, via the game controller, a first spin with a first game outcome for the first game instance and independently a second game outcome for the second game instance based on a random number generator;

activating, via the game controller, a third set of reel strips based on a user input received at the interface, the third set of reel strips being different from the first set of reel strips or the second set of reel strips;

generating, via the game controller, a merged game instance having a merged set of reel strips that includes the first set of reel strips and the second set of reel strips;

generating, via the game controller, a second spin and a merged game outcome with the merged set of reel strips; and evaluating, via the game controller, whether the merged game outcome includes a winning outcome.

10. The method of claim 9, further comprising independently selecting symbols from the first symbol set for the first game instance, and symbols from the second symbol set for the second game instance, respectively, in the merged game instance.

11. The method of claim 10, further comprising selecting symbols from a set of special symbols that includes a common symbol shared between the first symbol set and the second symbol set.

12. The method of claim 9, wherein the third set of reel strips includes a plurality of common symbols shared between the first symbol set and the second symbol set.

13. The method of claim 9, wherein the first set of reel strips includes a plurality of first wild symbols, and the second set of reel strips includes a plurality of second wild symbols, and wherein the third set of reel strips includes only the first wild symbols and the second wild symbols.

14. The method of claim 9, further comprising merging the first symbol set and the second symbol set into a merged symbol set and selecting symbols for the merged game instance from the merged symbol set.

15. A gaming machine comprising:

a first set of reel strips with a first set of symbols operable to form a first game instance;

a second set of reel strips with a second set of symbols that differs from the first set of symbols, and operable to form a second game instance;

a third set of reel strips that differs from the first set of reel strips or the second set of reel strips;

an interface to receive a user input; and a game controller having at least one processor and memory storing instructions, which, when executed, cause the at least one processor to at least:

generate a first game outcome for the first game instance and independently, a second game outcome for the second game instance, based on one or more random outcomes from e a random number generator, activate the third set of reel strips responsive to the user input received, generate a second spin and a merged game outcome with at least a portion of the first set of reel strips, at least a portion of the second set of reel strips, and the third set of reel strips, and evaluate whether the merged game outcome includes a winning outcome.

16. The gaming machine of claim 15, wherein the instructions, when executed, further cause the at least one processor to independently select symbols from the first set of symbols for the first game instance, and symbols from the second set of symbols for the second game instance, respectively, for the merged game outcome.

17. The gaming machine of claim 16, wherein the instructions, when executed, further cause the at least one processor to select symbols from a set of special symbols that includes a common symbol shared between the first set of symbols and the second set of symbols, for the merged game outcome.

18. The gaming machine of claim 16, wherein the third set of reel strips includes a plurality of common symbols shared between the first set of symbols and the second set of symbols.

19. The gaming machine of claim 15, wherein the instructions, when executed, further cause the at least one processor to provide a different number of reel strips in the third set of reel strips when the user input is activated differently.

20. The gaming machine of claim 15, wherein the first set of reel strips includes a plurality of first wild symbols, and the second set of reel strips includes a plurality of second wild symbols, and wherein the third set of reel strips includes only the first wild symbols and the second wild symbols.

* * * * *